US006260489B1

(12) United States Patent
Weaver et al.

(10) Patent No.: US 6,260,489 B1
(45) Date of Patent: Jul. 17, 2001

(54) WIRE WALL HANGER SYSTEM

(75) Inventors: Barbara J. Weaver; Charles R. Beinecke, both of Pickerington, OH (US)

(73) Assignee: ADD +ON Industries, Inc., Pickerington, OH (US)

( * ) Notice: Subject to any disclaimer, the term of this patent is extended or adjusted under 35 U.S.C. 154(b) by 0 days.

(21) Appl. No.: 09/379,157

(22) Filed: Aug. 23, 1999

(51) Int. Cl.[7] ..... A47B 5/00
(52) U.S. Cl. ..... 108/152; 108/42; 211/90.01
(58) Field of Search ..... 108/42, 152, 147.17; 211/90.01, 90.02, 90.04; 248/243; 52/36.4, 712; 411/340, 341, 457

(56) References Cited

U.S. PATENT DOCUMENTS

| | | | | |
|---|---|---|---|---|
| 560,884 | | 5/1896 | Anderson et al. . | |
| 2,206,588 | | 7/1940 | Tritt . | |
| 2,796,158 | * | 6/1957 | Miles et al. | 108/152 X |
| 2,909,352 | | 10/1959 | Van Buren, Jr. . | |
| 2,954,125 | * | 9/1960 | Husted | 108/152 X |
| 3,186,364 | | 6/1965 | Costantini et al. . | |
| 3,645,486 | | 2/1972 | Ferdinand et al. . | |
| 3,672,624 | | 6/1972 | Keller . | |
| 3,675,882 | | 7/1972 | Dibble . | |
| 3,752,088 | | 8/1973 | Kapnek . | |
| 4,051,789 | * | 10/1977 | Howitt | 108/152 |
| 4,319,531 | | 3/1982 | Caldwell . | |
| 4,372,516 | * | 2/1983 | Nyquist | 211/90.01 X |
| 4,441,433 | | 4/1984 | Caldwell . | |
| 4,637,194 | * | 1/1987 | Knowles | 411/457 X |
| 4,898,355 | * | 2/1990 | Steinway | 211/90.01 X |
| 5,170,723 | * | 12/1992 | Lewkowicz | 108/152 |
| 5,794,902 | | 8/1998 | Henry et al. . | |
| 5,819,957 | | 10/1998 | Hahn . | |

* cited by examiner

*Primary Examiner*—Peter M. Cuomo
*Assistant Examiner*—Hanh V. Tran
(74) *Attorney, Agent, or Firm*—Mueller and Smith, LPA

(57) ABSTRACT

A system for hanging implements on a wall which employs a hanging component formed of thin steel wire having two wire legs integrally joined to and spaced apart at a limiter portion. In a shelf supporting embodiment, bores or paired channels are provided within a shelf standard at a downwardly depending acute angle. The standard then is used with an elemental drill to form corresponding paired channels through a drywall surface. The wire bifurcate hanging components then are inserted through these channels at the noted acute angle to support a standard against a wall. The acute angle evokes an inwardly directed vector component providing a very stable and relatively high load bearing capacity. Removal of the shelf system from the wall is simply accomplished by lifting upwardly to reveal only small paired channel openings which are easily covered or resurfaced. A continuous strap based self supporting arrangement simplifies the mounting to and supporting of shelves from spaced apart standards.

22 Claims, 11 Drawing Sheets

WIRE WALL HANGER SYSTEM

CROSS-REFERENCE TO RELATED APPLICATIONS

None.

STATEMENT REGARDING FEDERALLY SPONSORED RESEARCH

Not applicable.

BACKGROUND OF THE INVENTION

For purposes of storage and decoration, building owners and dwellers frequently wish to hang implements on empty wall space. Such implements may be in the form of shelves, pictures, diplomas or other interior design accessories. Fasteners used to attach these implements to a wall surface desirably will be able to support potentially heavy loads, without damage to the wall structure, while maintaining an aesthetic appearance. Unfortunately, the size or bulk of a fastener generally is proportional to the given load it can bear. Weight particularly is a limiting factor when hanging shelves, as fasteners must support the weight of the shelf in addition to any items placed thereon.

Often the desired location of wall implements will change within a relatively short period of time. This is especially true in cases of apartment dwellings where high turnover among tenants is expected. Even in residential areas, owners frequently move. Those who stay in one place for a long period of time invariably wish to redecorate and in the process reposition or relocate existing wall implements.

To use common wall implement fasteners often requires making a substantial size hole in the wall. Wing-type fasteners include a bolt with two "wing" extrusions attached which extend normal to the length of the bolt. Once inserted through a wall, the bolt is fastened to hold the extrusions in tension against the back of the wall, supporting the weight of an implement affixed to the wall's forward surface. While the extruding wings may be folded together before being inserted through an opening in the wall, the widest portion of the fastener still may be three times the diameter of the bolt alone. To remove the fastener from the wall, the bolt is withdrawn and the wing portion falls down irretrievably into the wall cavity. Once such a fastener has been removed, a sizable hole in the wall remains.

Another type of fastener is that of a screw and an anchor. A hole is drilled in the wall surface and the anchor is inserted. The anchor has a forward face which abuts the forward surface of the wall when the anchor is inserted. A screw is inserted within the anchor causing the anchor at the back surface of the wall to expand. A wall implement is then supported by the screw. To remove the fastener, the screw and the anchor are both removed. While no pieces of the fastener must be replaced once removed from the wall as with the wing-type fasteners, a hole still remains in the wall whose size is proportional to the size of the fastener. Generally, the greater the weight required to be supported, the greater the size of the fastener and the resulting hole.

In addition to leaving an unsightly hole when removed, most fasteners may cause structural damage to the wall if an excessive load is placed on them. Placing a heavy implement on a fastener can cause the drywall around the hole to collapse or tear out. This is particularly true where the drywall is of relatively thin conventional thickness. It is readily apparent that the problems associated with the use of these types of fasteners are compounded by repeated repositioning of wall implements.

BRIEF SUMMARY OF THE INVENTION

The present invention is addressed to a wire-based system for hanging implements such as shelves and the like on a typical wall. The system achieves a substantial load bearing capacity without wall tear-out and with only a minimum sized wall entry. Intended particularly for use with so-called drywall surfaced wall structures, the system employs thin, wire-form hanging components which, preferably. are bifurcate structures with two, generally parallel legs extending from an integrally formed limiter portion. When used with a dedicated shelf supporting standard, channels for receiving the legs are predrilled in the standard at an acute angle with respect to the wall surface. Using the standard as a jig, the same angle is used to drill paired mounting channels through the wall. Thus, when the standard is mounted upon the vertical wall surface, it is supported by the wire bifurcate hanging components in a manner wherein the load imposed from a standard supported shelf exhibits an inwardly directed horizontal force vector component to assure structural stability of the shelf system.

Of additional interest with respect to the wire-based system, it is quite easy to remove the mounted standards from the wall. For a typical embodiment, a slight upward and outward lifting force is all that is required. Following such removal, only paired, very small diameter bores remain in the wall which are very easily covered or resurfaced. The load carrying capability of this wire-based hanging system is quite substantial. In this regard, the number of hanging components utilized to support a standard of a shelf-based system is selected with respect to the load to be imposed. Thus, the standards are produced with a plurality of the angularly oriented standard channels and drilling through these angularly oriented channels into the drywall surface requires only the most elementary of drilling tools. For example, a quite simple and thus disposable hand actuated drilling implement may be supplied with the assembly for the user. Load capacities are particularly enhanced with the utilization of a hanging component formed having relatively longer legs. This length is such that the legs will penetrate a drywall component and extend within the interior wall cavity to abut against the internal surface of the opposite side of the wall. As a consequence, a form of fulcrum and captured lever arm is evoked with the legs depending downwardly, for example, at about a 30° angle. The resulting structure is quite strong with very high load bearing capacity while producing only the noted very minimal disfigurement of the wall manifested by paired very small diameter channel holes.

A simplified shelf assembly is described in connection with the hanging components and standards. With this shelf arrangement, thin, flexible polymeric suspension components provided as straps are employed. These straps are configured as a continuous loop wrapped essentially about a standard between upper and lower connector locations. The straps are of a material having high resistance against strain in tension but remain quite flexible otherwise. A shelf is abuttably inserted within the loop defined by the straps and, because of the strap lengths, the loop becomes a right triangle for which the shelf is a base. With the arrangement, the shelf is compressibly engaged in abutment with the standards while the straps are retained in tension, and the mounting of a shelf to paired standards is manifestly simple.

The system of the invention permits the configuration of shelves for mounting within a comer or union between two intersecting walls. In one such self system, the hanging components are inserted through shelf support assemblies in a manner wherein they penetrate the walls at a 90 degree angle. However, because of the structuring of the shelf itself, the support assemblies are "locked" into position to provide an assured mounting integrity.

Other objects of the invention will, in part, be obvious and will, in part, appear hereinafter. The invention, accordingly, comprises a system and apparatus possessing the construction, combination of elements and arrangement of parts which are exemplified in the following detailed disclosure.

For a fuller understanding of the nature and objects of the invention, reference should be had to the following detailed description taken in connection with the accompanying drawings.

DETAILED DESCRIPTION OF THE INVENTION

Figure 1:
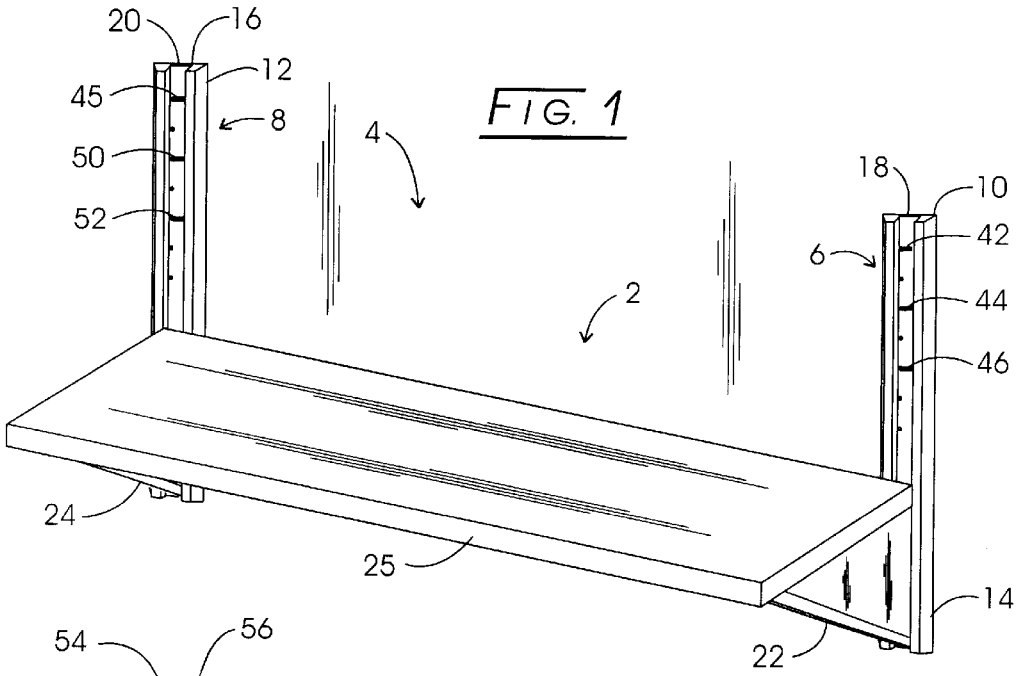
FIG. 1 is a perspective view of a shelf supported by two standard assemblies attached to a wall by six hanging components.

The system of the invention finds its most predominant use in mounting shelf assemblies on conventional wall structures. These wall structures typically will be formed of conventional wallboard, in turn nailed to vertically upstanding wall studs. In general, the wall will have two oppositely disposed parallel wall components formed of the wallboard, and those two components will define a cavity due to their mutual spacing. A shelf and standard implementation of the system is revealed in FIG. 1 and shown generally at 2. System 2 is mounted upon a wall surface shown generally at 4 and is seen to be formed with two standard assemblies 6 and 8. Each standard assembly 6 and 8 includes a respective vertically oriented standard, as at 10 and 12, each of which is formed of material such as wood, plastic, metal or a combination of these. A particularly desirable material is medium density fiberboard (MDF) formed having a particulate core with oppositely disposed thin wood skin surfaces laminated to it. The rear or wall engaging surfaces 14 and 16 of standards 10 and 12, respectively, are positioned against wall surface 4. Note that each standard 10 and 12 is formed having a centrally disposed slot or channel shown respectively at 18 and 20. Within these slots 18 and 20, there are positioned, respectively, two triangular-shaped brackets 22 and 24. Preferably, these brackets are glued within the respective slots 18 and 20. A preferred adhesive for this purpose is marketed by Franklin Glue Corp. of Columbus, Ohio under the trade designation "Assembly 65". Brackets 22 and 24 support a conventional wooden shelf 25, the upper surface of which will hold a load, i.e. a household implement, which must be wall supported by the system 10. In general, that load will impose a downward vector and a horizontally inwardly depending vector, in consequence of the geometry of the system 2. This load is supported by a series of generally U-shaped hanging components. The components are shown in the figure in their fully inserted or fully nested orientation such that only the transverse or limiter outer portions are revealed.

Figure 2:
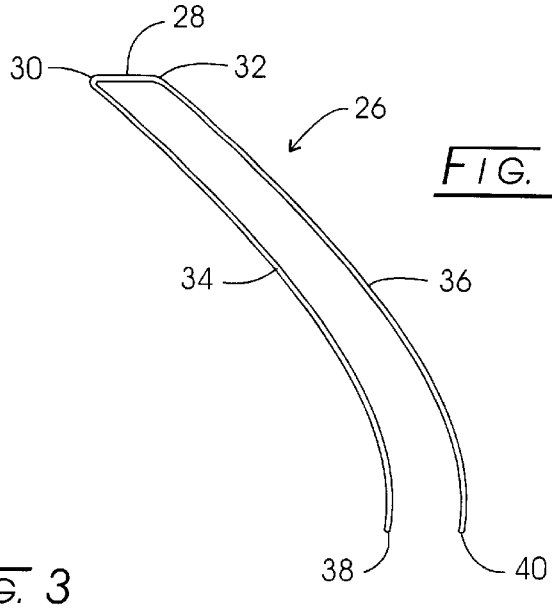
FIG. 2 is a perspective view of a bifurcate hanging component having two legs.

Looking momentarily to FIG. 2, such a hanging component is revealed in perspective fashion generally at 26. Hanging component 26 is formed as a unitary, bifurcate assembly having a transverse portion 28 integrally formed with and extending between base portions 30 and 32. Thin legs 34 and 36 extend from base portions 30 and 32, respectively, to tips 38 and 40. Although hanging component 26 has been described as being bifurcate, a hanging component with a single leg also may be used. With a single leg configuration, the limiter portion is integrally formed transversely to the leg in a T- or L-shape. One of the advantages of system 2 is realized by the diminutive diametric dimensions of legs 34 and 36. These thin legs 34 and 36 are flexible and easily inserted into a wall through which correspondingly small bores have been formed. To achieve these diminutive dimensions, hanging component 26 may be formed, for example, of thin steel piano wire (A5TM-A228) having a thickness ranging between about 0.05 inch to about 0.054 inch. When a hanging component is removed or repositioned, the bores remaining in the wall, having such small dimension, are easily concealed. Despite their diminutive diameters, each hanging component allows system 2 to support a substantial load. This is in part due to a unique component/wall geometry. Each hanging component is inserted in the wall at an acute angle with respect to the outer wall surface, the preferred acute angle being about 25 to 30 degrees. This evokes the above-noted inwardly directed force vector. Further, legs of the hanging components will be seen to extend across an internal wall cavity and into abutting contact against the opposite wall back surface in the wall cavity. Thus, the hanging components are restrained by the internal wall surface to develop a lever arm form of structural integrity. To facilitate this biasing, the leg regions adjacent tips 38 and 40 of respective legs 34 and 36 may be bent or canted downwardly as shown in FIG. 2. Because of the unique component/wall geometry, each bifurcated hanging component can generally contribute support of about twenty pounds without discernable wall tear-out.

Returning to FIG. 1, it may be seen that standard 10 is attached to wall 4 with three mutually vertically disposed hanging components 42, 44, and 46, while standard 12 is attached to the wall with mutually vertically disposed hanging components 48, 50, and 52. These hanging components are fully inserted so that the transversely disposed limiter portions are flush with the front surface of the slots of the standards. Thus being attached to the wall by six hanging components, shelf system 2 may support a weight of at least about 120 pounds. To receive these hanging components, a pattern of standard bores or channels is provided through standards 10 and 12 so that the hanging components may be inserted through the standards before being inserted through the wall. These bores extend from forward openings in the forward surface of standards 10 and 12 through the standards thickness to emerge from their rear surfaces at an acute angle.

Figure 3:
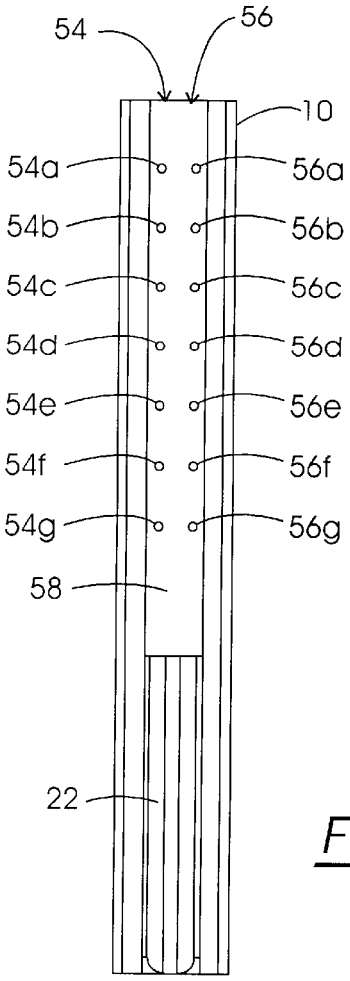
FIG. 3 is a front view of a standard bearing a series of bores.

Looking briefly to FIG. 3, a front view of a standard assembly 6 with pairs of standard bores is revealed. These standard bores are seen to be aligned in two vertical rows, shown generally at 54 and 56, the paired bore openings being shown at 54*a*,56*a*–54*g*,56*g*. Standards having pairs of bores are designed for use with bifurcate hanging components such as those shown in FIG. 2. The horizontal distance separating the standard bores of each pair is commensurate with the length of the limiter portion 28 extending between the legs of the bifurcate hanging components. In forming these paired standard channels, the bores are drilled at the noted acute angle with respect to front or forward face 58 of the standard so that when the hanging components are inserted through the standard bores, they are positioned to be inserted through a wall at the desired acute angle. If hanging components having single legs are employed, only a single vertical row of bores is required.

Figures 4, 4A:
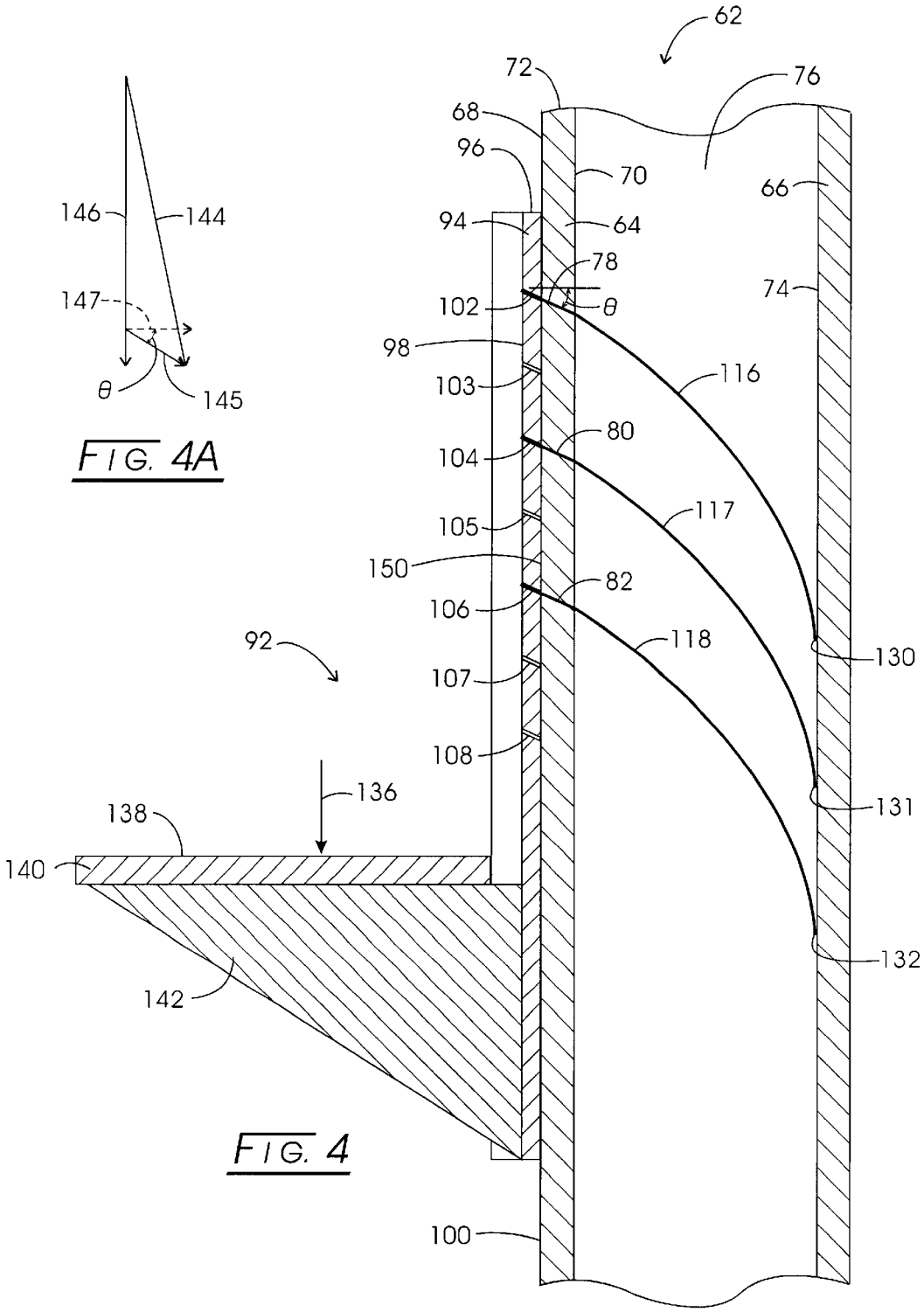
FIG. 4 is a partial sectional view of a standard supported shelf assembly in combination with a partial sectional view of a wall upon which the assembly is mounted.
FIG. 4A is a simplified vector diagram illustrating the distribution of a load evoked with the hanging components of the invention.

Turning now to FIG. 4, a partial cross-sectional view of a shelf supporting standard/hanging component assembly in combination with a conventional wall reveals the important hanging component/wall relationship. A conventional wall, shown generally at 62, is composed of two oppositely disposed wall components (drywall sheets) 64 and 66. Wall component 64, having an exterior surface 68, extends to an interior surface 70 defining a wall thickness 72. Wall component 66 has an oppositely disposed interior surface 74 spaced apart a distance from interior surface 70 to form an internal cavity 76. Formed from forward openings in exterior surface 68, three wall bores or wall receiving channels 78, 80, and 82 extend downwardly through thickness 72 at an acute angle, θ, for example, about 25° to 30° with respect to exterior surface 68. This acute angle θ at which the wall bores are formed is the same angle at which the standard bores are formed. A standard assembly is shown generally at 92 positioned against exterior surface 68 of component 64. Note that assembly 92 includes a standard 94 extending a standard thickness 96 from a forward face or surface 98 to a wall engaging face or surface 100. Standard 94 is configured with a series of standard bores or channels each of which extends from a forward opening, such as those shown in FIG. 3, in forward surface 98 through thickness 96 to wall engaging surface 100. Seven such bores are shown at 102–108. When wall engaging surface 100 is positioned in attachment against wall exterior surface 68, appropriate standard bores are aligned with the wall bores. Three hanging components 116–118 are shown in a fully inserted orientation, attaching standard assembly 92 to wall 62. The standard bores 102–108 will be seen to serve as jigs to ensure that the hanging components will be inserted at the noted acute angle θ with respect to a plane perpendicular to the wall, thus providing one element of the component/wall geometry. As discussed above, the legs of the hanging components are provided having a length such that the portions of them adjacent their tips will abuttably engage interior surface 74 of wall component 66. In this regard, the tip regions of components 116–118 are seen to develop such an abutting relationship respectively at 130–132. The figure also reveals that the earlier described cant (FIG. 2) facilitates this abutting relationship. In effect the hanging components constitute a bifurcate lever arm having a very long arm component extending from a fulcrum represented by wall component 72 and locked in position by abutment with interior surface 74. The load to be supported by this lever arm is imposed on shelf assembly 92, as represented by arrow 136, directed toward the upper surface 138 of shelf 140 which is supported at one end by a bracket 142.

Looking briefly to FIG. 4A, a simplified vector diagram illustrates a force vector arrangement developed by load 136 on shelf assembly 92. For the sake of simplicity, the force exerted by the load first is considered as acting on a single hanging component. Because the hanging component is positioned at an acute angle, θ, with respect to a plane perpendicular to the wall, the load develops a force vector 144 corresponding to its weight. This (resultant) vector now may be represented by an inwardly directed vector component shown at 145 and a downwardly directed vertical vector component shown at 146. Component 145 will exhibit an inwardly (horizontally) directed vector component 147. Where additional hanging components are added to the system, the horizontal and vertical forces are exerted somewhat proportionally, assuming that the load is equally distributed. Any moment developed by the effective location of load 136 is accommodated by the inwardly directed vector 145.

Turning now to FIGS. 5–10, a method for mounting a standard assembly, such as that shown generally at 6 in FIG. 1, on a wall surface is demonstrated. Numeration of features described above in connection with FIGS. 1, and 3 is retained.

Figure 5:
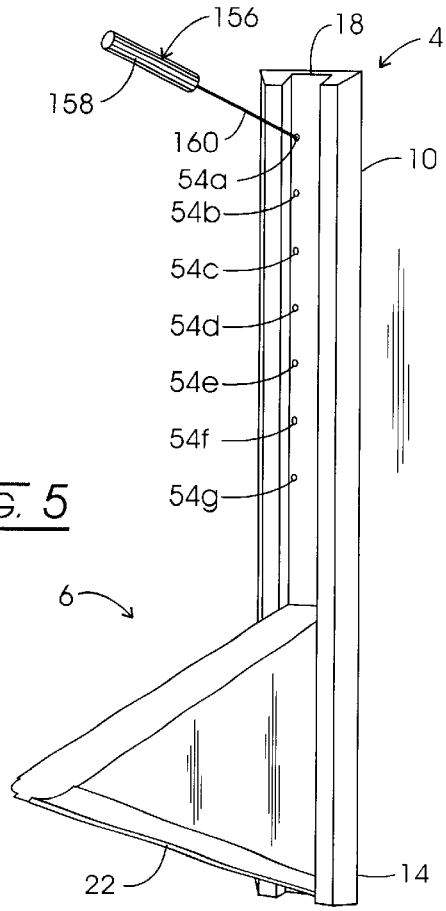
FIG. 5 is a perspective view of a tool inserted through a standard bore to drill through a wall and form two horizontally aligned wall receiving bores.

FIG. 5 illustrates the technique for formation of two wall bores at the acute angle θ using earlier described standard assembly 6, a drilling tool 156, and hanging components 42, 44, and 46. Tool 156 is seen to have two component parts, a cylindrical handle portion 158 and a drilling portion 160. Drilling portion 160 may, for example, be made of wire having a sharp tip capable of drilling through drywall material. To form the wall bores, vertically oriented standard 10 of assembly 6 is positioned at a desired location against the wall surface 4. With standard assembly 6 positioned on the wall, it may be used as a jig to form a wall bore at the noted acute angle θ. Once drilling portion 160 has been inserted fully through the channel associated with standard bore opening 54*a*, the standard channel will have positioned drilling portion 160 at the noted angle θ with respect to a plane perpendicular to wall 4. The wall bore is formed by hand drilling downwardly through the wall with the sharp tip of drilling portion 160 until the tip extends through to an interior cavity, such as that shown at 76 in FIG. 4. In similar fashion, a second wall bore is formed using the channel extending from standard bore opening 56*a* (FIG. 3) to orient drill portion 160. It should be noted that drilling portion 160 has a dimension which is of the same general size but slightly smaller than that of the standard bores.

Figure 6:
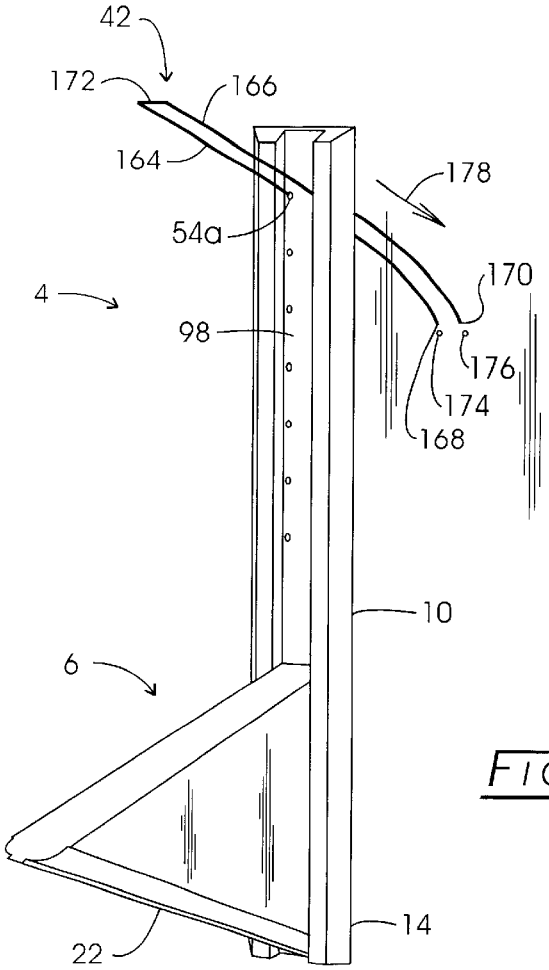
FIG. 6 is a perspective view of a standard assembly being attached to a wall by inserting a bifurcate hanging component through two standard bores and two wall bores.
Figure 7:
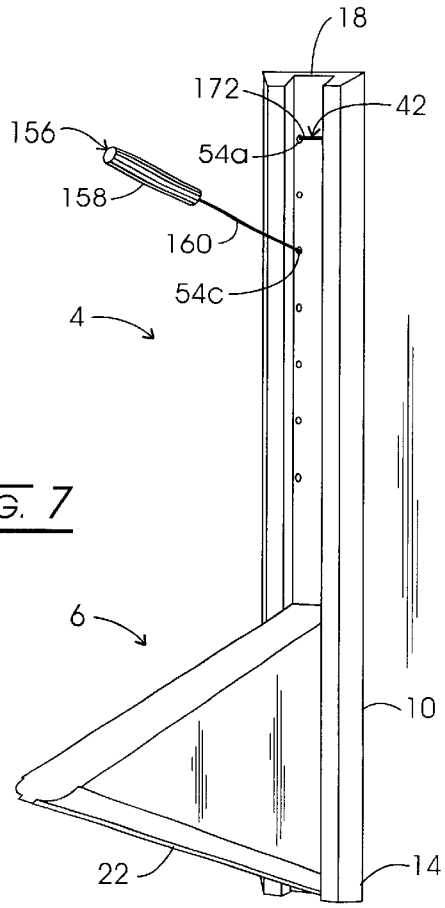
FIG. 7 is a perspective view of a tool being inserted into a channel of the attached standard assembly of FIG. 6 to drill through the wall and form additional horizontally aligned wall bores.

The next step of the mounting procedure is illustrated in connection with FIG. 6. The figure reveals that two wall bores 174 and 176 will have been formed with the above-noted drilling procedure. Following removal of tool 156 from the second bore, the user inserts the bifurcated leg portions of a hanging component through the forward openings 54*a* and 56*a* of the standard. As seen in the figure, bifurcated hanging component 42 is provided having legs 164 and 166 extending from integrally formed transverse portion 172. Legs 164 and 166 are positioned partially through the noted standard bores or channels extending from openings 54*a* and 56*a* (see FIG. 3). Thus, the tips 168 and 170 of respective legs 164 and 166 can be guided into the wall bores 174 and 176 by the installer. Insertion is facilitated by holding standard 10 at an acute angle with respect to wall 4. Once so inserted, the inward surface 14 of standard 10 is positioned against the wall surface 4 as indicated by the directional arrow 178 and the hanging component 42 is fully inserted. The standard 10 now will hang in a vertical orientation in adjacency with wall 4.

Figure 8:
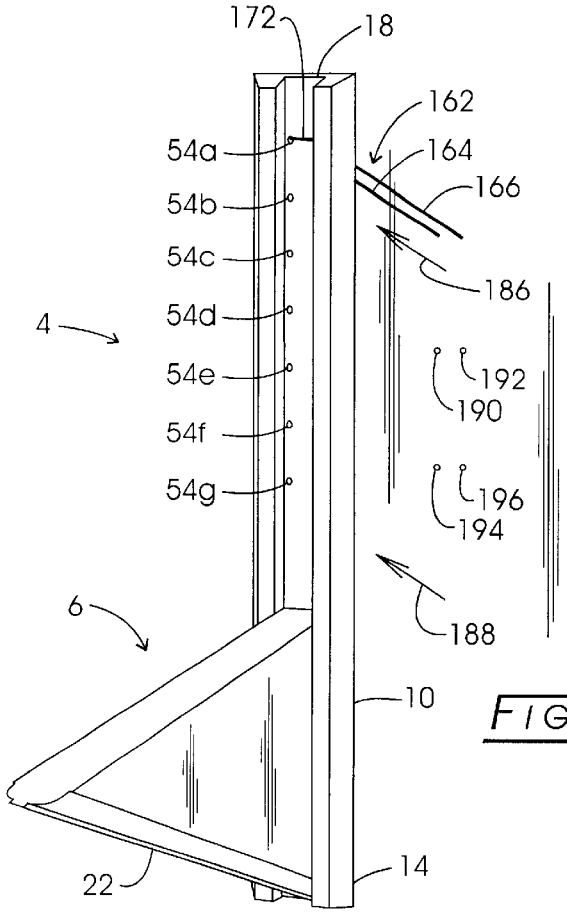
FIG. 8 is a perspective view of the standard assembly of FIG. 7 having been pulled outwardly from a wall.

Looking to FIG. 7, tool 156 again is accessed and a select number of paired wall bores are formed as the standard assembly 6 is supported from the hanging component 42. It may be recalled that the number of hanging components utilized is increased to accommodate higher and higher loads. However, it is preferred to always use at least two vertically spaced apart hanging components with each standard assembly. Once the additional wall bores have been formed, standard assembly 6 is pulled outwardly part way from the wall (preferably at an angle) by the user so that the additional hanging components may be installed. Turning to FIG. 8, standard assembly 6 is shown partially removed from the wall. By pushing upwardly on the assembly 6 as indicated by directional arrows 186 and 188, it will be pulled partially outwardly from the wall surface 4. This maneuver of withdrawal of the assembly 6 from the wall surface 4 is quite easily accomplished by applying a minor force representing an opposite direction as the load direction represented by arrow 136 in FIG. 4. In effect, the vector components represented by the vector diagram in FIG. 4A are reversed and reduced in length. With the assembly 6 in a partially withdrawn position, the additional wall bores formed in the previous step (FIG. 7) are seen represented at paired openings 190 and 192 and 194 and 196. Looking to these forward openings, the diminutive size of the associated wall bores may be appreciated.

Figure 9:
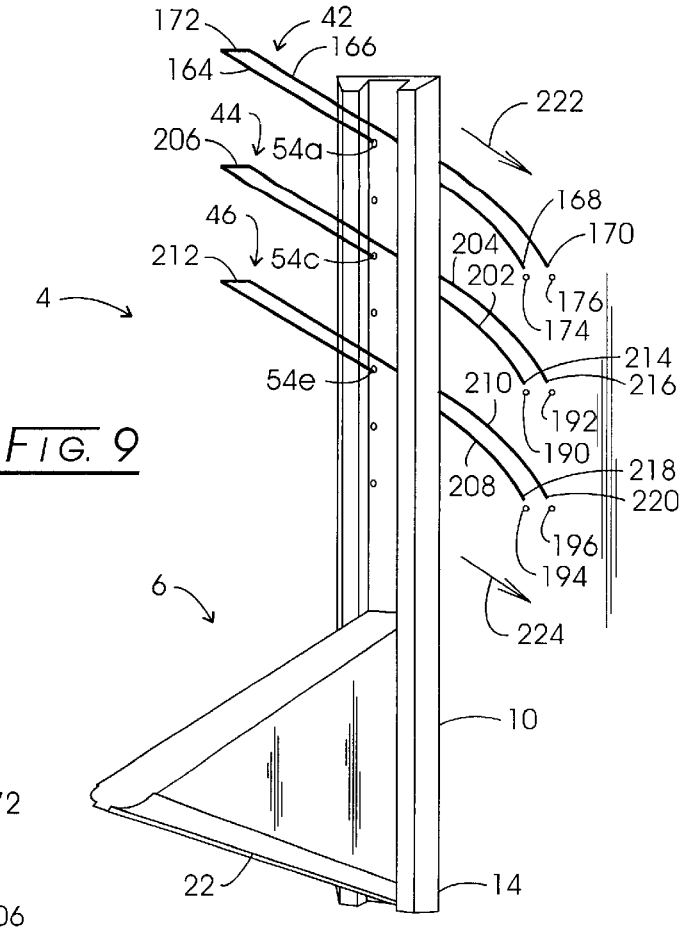
FIG. 9 is a perspective view of a standard assembly being attached to a wall by inserting the legs of three hanging components through the wall bores formed as discussed in connection with FIG. 7.
Figure 10:
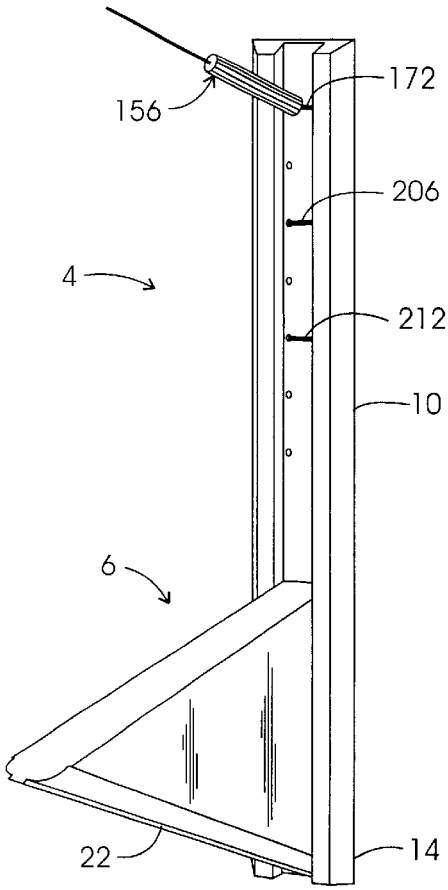
FIG. 10 is a perspective view of the tool of FIG. 5 applying pressure to a hanging component.

FIG. 9 reveals the penultimate step in the procedure for mounting the assembly 6. Following the procedure described in FIG. 8, the user partially inserts the legs of two additional bifurcated hanging components 44 and 46 through the channels associated with respective forward opening pairs 54*c* and 56*c* and 54*e* and 56*e* (see also FIG. 3), of standard 10. As seen in the figure, component 44 is provided having legs 202 and 204 extending from integrally formed transverse portion 206 to tips 214 and 216, while component 46 is provided having legs 208 and 210 extending from integrally formed transverse portion 212 to tips 218 and 220. The tips of the legs of the three components can be guided into the corresponding wall bores by the installer and, once this insertion is accomplished, the entire assembly 6 then is pushed inwardly and downwardly as indicated by the directional arrows 222 and 224. While not shown, hanger component insertion in the wall is facilitated by holding the bottom of standard 10 against the wall and angling the top rearwardly therefrom. To ensure that the bifurcate hanging components 42, 44, and 46 are fully inserted, the flat back surface of tool handle 158 may be used, as shown in FIG. 10, to seat the transverse portions 172, 206, 212 flush against the forward surface of standard 10.

Once assembly 6 has been mounted on the wall, a second vertically oriented standard assembly is mounted on the wall by the user following the same procedure as above. This second standard is aligned in mutual parallel verticality with standard assembly 6 and located a horizontal distance away, that horizontal distance being determined by the length of the shelf to be supported between the standard brackets. With the two standard assemblies mounted on the wall, a shelf may be positioned horizontally on the shelf brackets as at 22 and 24 (FIG. 1) to complete shelf system 2.

As is apparent, at such time as it is desired to remove a previously mounted shelf system as at 2, the user merely removes the load and associated shelf from the brackets. Each standard assembly then is removed. The earlier noted procedure of pushing upwardly on the assembly and gently pulling outwardly provides for removal quite easily. In general, the motion involved is one represented by the arrows 186 and 188 in FIG. 8. As before, the removal is easily accomplished, resulting in a reversal of the vector directions of FIG. 4A. Of course, for that analysis to obtain, the vector lengths are reduced in view of the removal of heavier loads. The procedure for covering the pair of wall bores is quite simply carried out, inasmuch as their diameter is diminutive.

Figure 11:
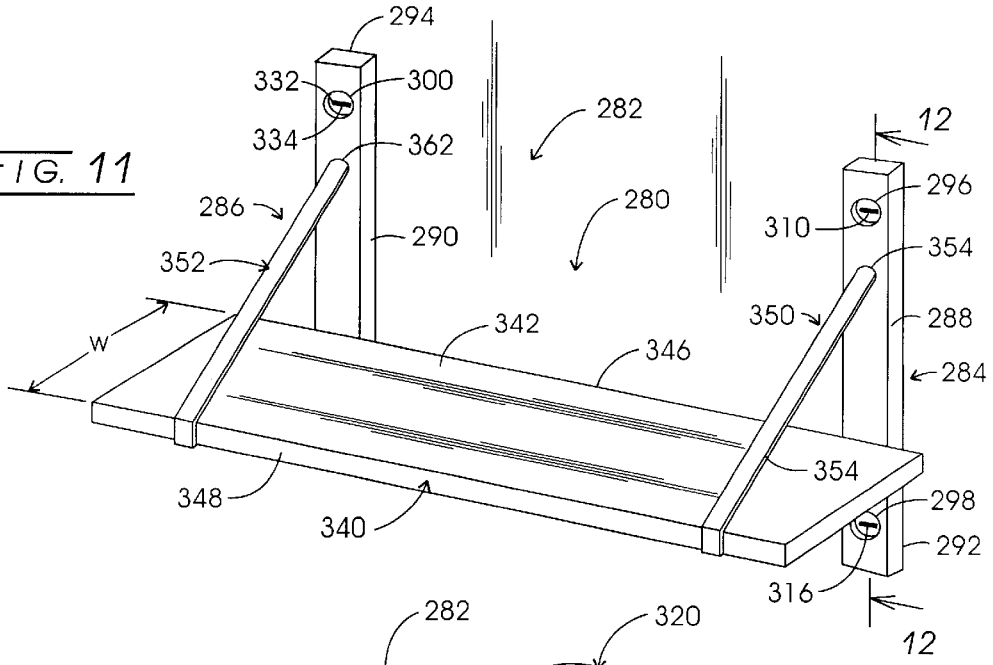
FIG. 11 is a perspective view of a shelf supported by straps extending from two spaced standard assemblies.
Figure 12:
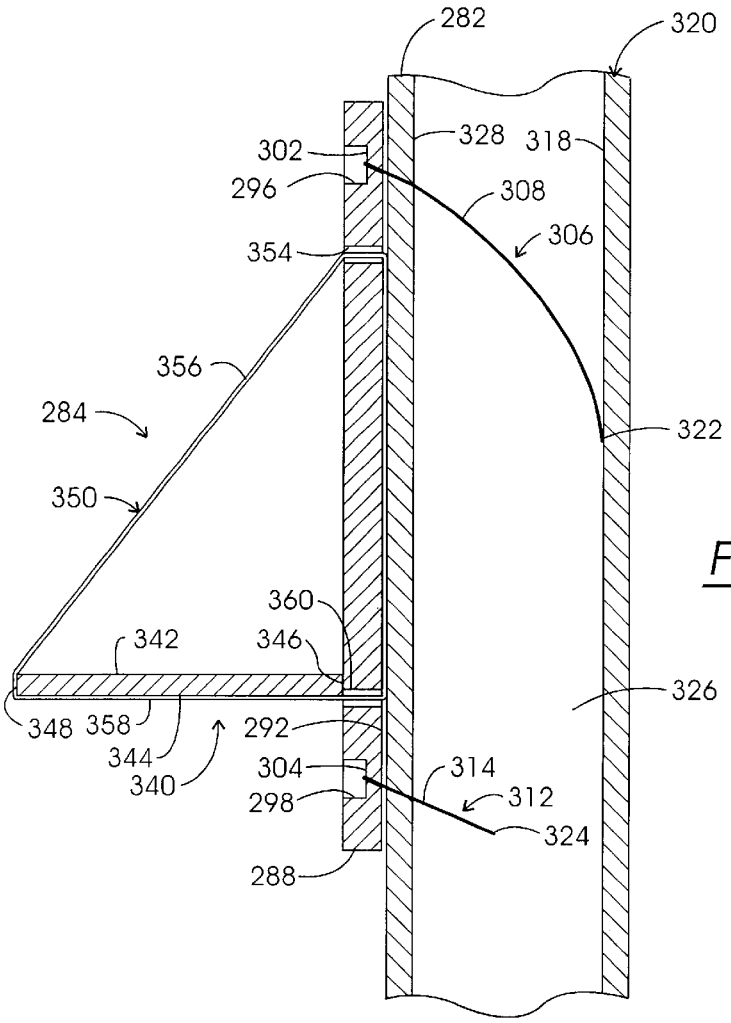
FIG. 12 is a partial sectional view taken through the plane 12—12 of FIG. 11 in combination with a partial sectional view of a wall.

Turning now to FIG. 11, another shelf and standard implementation is revealed wherein a suspending shelf support arrangement utilizing suspension components replaces the triangular brackets used with the previously described shelf system. The present shelf system, shown generally at 280, is mounted upon a wall surface, represented generally at 282, and is seen to be formed with two standard assemblies 284 and 286. Each standard assembly includes a vertically oriented standard, as at 288 and 290, which may be formed of wood, metal, plastic or any combination of these. As with the standards described in connection with the previous shelf system, a particularly desirable material is medium density fiberboard (MDF) formed having a particulate core with oppositely disposed thin wood skin surfaces laminated to it. The rear or wall engaging surfaces 292 and 294 of standards 288 and 290, respectively, are positioned against wall surface 282. The hanging component based mounting of standards 290 and 292 is somewhat altered with respect to the earlier described version. In this regard, the hanging components are received within cylindrically shaped recesses which are developed as partial bores. In this regard note that standard 292 contains two such recesses, an upper one at 296 and a lower one at 298. In similar fashion, the standard 290 is formed with a cylindrical recess 300 at its top and a similar lower disposed recess (not shown) corresponding with that identified at 298. Extending in from the inwardly disposed surfaces are hanging components mounting standards to the wall 282. In this regard, looking additionally to FIG. 12, it may be seen that recess 296 extends to an inner surface 302 and that recess 298 extends to an inner surface 304. FIG. 12 shows that a bifurcate hanging component shown generally at 306 is inserted through paired standard channels and wall channels at an acute angle. In this regard, one leg 308 of the hanging component 306 is revealed in FIG. 12. The transverse portion of component 306 which extends between its two elongate legs is seen at 310 in FIG. 11. In general the inner surface 302 will be covered with a decorative cloth material, wood, nylon buttons or other decorative material which is adhesively applied. A hanging component 312 is inserted within appropriate standard channels and wall channels aligned from the inner surface 304 and recess 298. Note that this hanging component 312, while having the bifurcate or U-shaped construction described above is formed with foreshortened thin legs one of which is seen in FIG. 12 at 314. The transverse portion of the hanging component 312 is seen in FIG. 11 at 316 abuttably engaged with the inner surface 304 of recess 298. Note that the foreshortened legs 314 of the hanging component 312 do not touch the interior surface 318 of an oppositely disposed wall component represented generally at 320. In this regard, the tip 322 of leg 308 of hanging component 306 extends into abutting adjacency with the interior surface 318 of wall component or drywall sheet 320. However, the corresponding tip 324 of leg 314 terminates in the interior cavity space 326 defined between interior wall surface 318 and wall surface 328.

A similar mounting arrangement is provided in connection with standard 290. In FIG. 11, recess 300 is seen to extend to an inner surface 332. Extending inwardly from the surface 332 are paired standard channels which communicate with corresponding wall channels formed within wall 282 in the manner described above. A bifurcate hanging component is inserted through those channels, the transverse portion thereof being seen in FIG. 11 at 334.

Standard assemblies 284 and 286 support a shelf represented generally at 340 which is shown having a given width, upper surface 342 and a lower surface (FIG. 12) 344. The inwardly disposed longitudinal edge 346 of shelf 340 is positioned in compression and in abutment against the outwardly disposed surfaces of standards 288 and 290. There is no attachment other than compressive abutment and this compressive force is imposed against the outwardly disposed edge 348 of shelf 340 by spaced apart, flexible suspension component assemblies shown generally at 350 and 352. Suspension component assemblies 350 and 352 preferably comprise thin flexible polymeric straps which exhibit essentially no strain in tension. FIG. 12 reveals that the suspension component 350 is a continuous loop of predetermined length having one segment extending along the inward surface 292 of standard 288. The strap-shaped suspension component 350 then extends through standard 288 at an upper connector location 354. This upper connector location is implemented as a cylindrical through-bore having a diameter somewhat commensurate with or slightly larger than the widthwise extent of the strap-shaped suspension component 350. The suspension connector 350 then extends angularly outwardly and downwardly as represented at segment 356 to compressive engagement with the edge 348 of shelf 340. Note that the segment 356 defines a hypotenuse of a right triangle with a base represented by shelf 340 and a vertical leg represented by standard 288. From its compressive engagement with the shelf edge 348 as seen in FIG. 12, the strap-shaped suspension component 350 extends as represented at segment 358 in adjacency with the lower surface 344 of shelf 340 to a lower connection location 360. Connection location 360 is also formed as a cylindrical through-bore having a diameter slightly larger than the widthwise extent of the strap-shaped suspension component 350. The continuous strap-shaped component 350 then extends along the interior disposed surface of standard 288 between the connection locations 354 and 360. The right triangular geometry developed is predicated upon selecting the proper length for the suspension component 356. As represented in FIG. 11, suspension component 352 is configured in the same manner as component 350.

In mounting the shelf 340, it is slid within the loops defined by the suspension components 350 and 352 in somewhat of a vertical orientation. The rear edge 346 of shelf 340 then is positioned in abutment against the forward surfaces of the standards 288 and 290 and the shelf then is rotated about its abutting edge 346 into the orientation shown in FIGS. 11 and 12. The result is the application of substantial compressive stress by suspension component assemblies 350 and 352 to fully support the shelf for contemplated loads such as textbooks or the like. A secondary advantage accruing from the hypotenuse defining segments of the suspension component assemblies is that they function as book ends for a line or collection of books extending across the shelf 340.

The requisite compressive abutment of shelf 340 against the standards 288 and 290 may be maintained even though the lower connection location 360 is positioned below the lower surface 344 of shelf 340. As before the length of the strap-shaped suspension component is selected such that the hypotenuse defining segment as at 356 is retained in adequate tension to impose the compressive abutment of edge 346 of shelf 340 against the forward surfaces of standards 288 and 290.

FIG. 11 reveals that the upper connector locations as at 354 or 362 in the case of standard 290 as well as the lower connector locations with the noted diametric extents, impose a slight curve to the straps constituting the assemblies 350 and 352. In a typical application, the suspension components 350 and 352 are implemented as polypropylene bands having a width of three-eighths inch. The cylindrical bores at the lower and upper connector locations as at 360 and 362 are typically formed having a one-half inch diameter. As noted, while the polymeric straps are flexible they have high tensile resistance against strain. To form the continuous loop illustrated, the ends of each strap piece are thermally bonded together.

Figure 13:
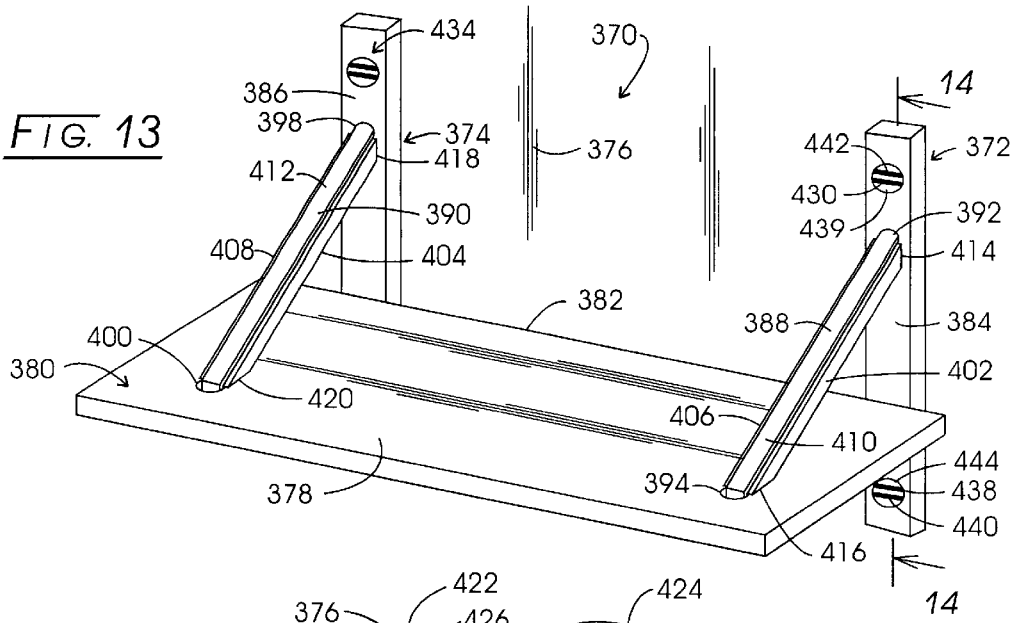
FIG. 13 is a perspective view of a shelf supported by straps extending from two spaced standard assemblies.
Figure 14:
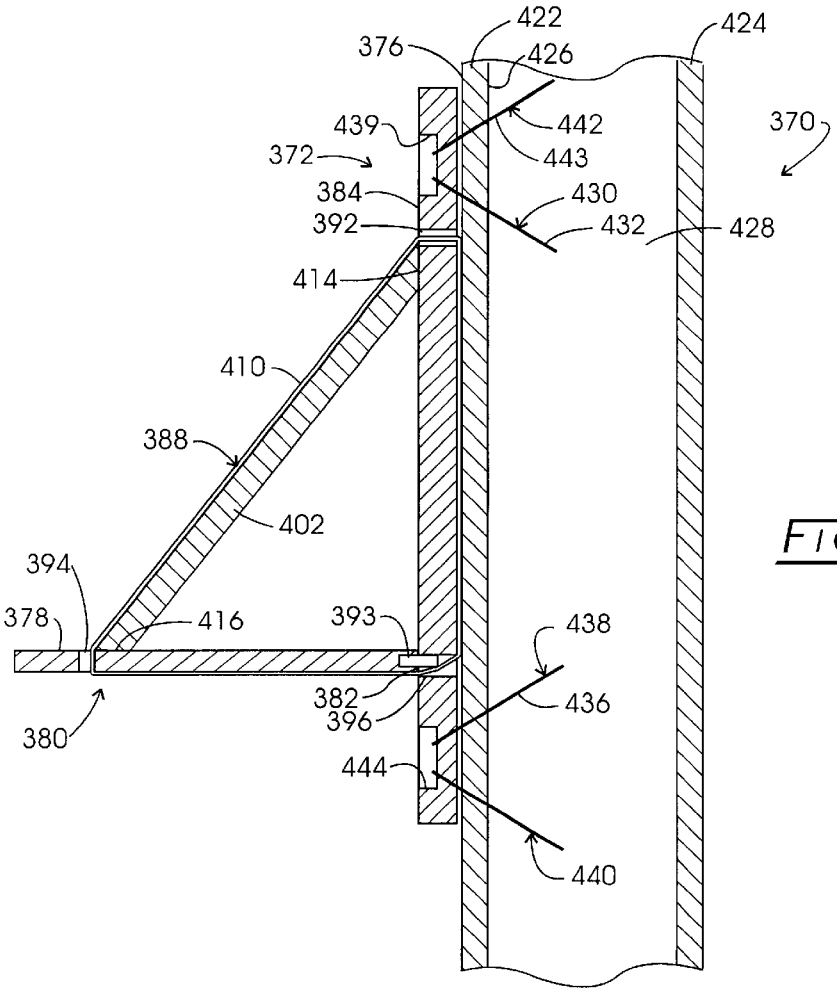
FIG. 14 is a partial sectional view taken through the plane 14—14 of FIG. 13 in combination with a partial sectional view of a wall.

Referring to FIGS. 13 and 14, an adaptation of the system 280, described above in connection with FIGS. 10, 11 and 12, is presented. This system, represented generally at 370, is intended particularly for smaller shelf assembly applications wherein the elongate hanging components as described at 306 in FIG. 12 are not called for. In FIG. 13, the assembly 370 is seen to be comprised of two mutually oppositely disposed vertically oriented standard assemblies represented generally at 372 and 374. Assemblies 372 and 374 are attached to a wall component, the forward surface of which is represented at 376. Standard assemblies 372 and 374 function to support and abuttably engage a rectangular shelf which extends from an edge region 380 to a rear edge 382. Shelf 378 and, in particular, edge 382 is retained compressively in abutment against the forward surfaces of respective assemblies 372 and 374 by two spaced apart suspension component assemblies represented generally at 388 and 390. To aid the installer, two small polymetric pegs, one of which is shown at 393, extend from rear edge 382 of shelf 378. These pegs fit loosely within the through-bore 396. FIG. 14 reveals that suspension component 388, implemented as a continuous strap as discussed above, extends from a connection location 392 implemented as a bore of about one-half inch diameter thence though a bore, again of about one half inch diametric extent within the outer edge region 380 of shelf 378, and thence through the through-bore implemented connection location 396 extending through the standard assembly 372 somewhat aligned with the lower edge of shelf 378. Note that strap 388 abuts against the lower edge of peg 393 to urge it upwardly against the top surface of the through-bore at 396. A similar arrangement provides for mounting of suspension component assembly 390. FIG. 13 shows an upper connection location 398 extending through standard assembly 374 and a bore 400 formed through shelf 378 at region 380. For this embodiment, however, note that two wooden strap guides 402 and 404 are positioned in abutting adjacency with the rearward sides of strap implemented suspension component assemblies 388 and 390. The forward surfaces of each of the guides 388 and 390 are formed having an elongate slot shown respectively at 406 and 408, within which the forward or hypotenuse defining segments 410 and 412 of assemblies 388 and 390 are retained. It may be observed in FIG. 14, that strap guide 402 is mitered to a defined oppositely disposed five end surfaces inserts 414 and 416 which are in freely abutable contact respectively with forward surface 384 of standard assembly 372 and the upwardly disposed surface of shelf 378. The corresponding end surfaces provided with strap guide 404 are seen in FIG. 13 at 418 and 420. The forwardly disposed slots 406 and 408 may be decorated, for example, with ribbon.

FIG. 14 shows that the wall establishing forward surface 376 is fashioned from two wall board components represented at 422 and 424. The interior surface of wall board component 422 is shown at 426 and the two components 422 and 424 are spaced apart and parallel to each other to define an interior cavity 428. Because of the small size and corresponding smaller load of system 370, the small hanging components as described in 312 in connection with FIG. 12 may be employed to support the standards 372 and 374. In this regard, FIG. 14 shows that a bifurcate or U-shaped hanging component 430 extends at partial bore 439 through standard channels formed at an acute angle with respect to a plane perpendicular to the forward surfaces of the assemblies 372 and 374. FIG. 14 shows a downwardly angled leg 432 extending through the standard 372 and through the wall component 422. For smaller shelf assemblies, a singular uppermost bifurcate hanging component will provide adequate support when implemented with respect to both standard assemblies 372 and 374. However, a second, upwardly angled hanging component 442 having an upwardly angled leg 443 may be installed to, in effect, "lock" the upper region of the stand in place. For this arrangement, two pairs of vertically spaced standard channels are provided. The exposed transverse components of hanging component 430 and 442 are seen in FIG. 13. corresponding pair of such hanging components is represented generally at 434 in conjunction with standard 374.

Because of the shorter legs as at 432 and 443 of the instant hanging components, they may be inserted within wall component 422 without the prior formation of a wall channel. To facilitate this insertion, the tips of the hanging components are sharpened and they are formed for example of a phosphate coated music wire or a heat treated stainless steel material. FIG. 14 reveals that the connection provided at the lower region of the standards may be provided in the manner described above wherein the acute angle earlier described at theta is formed angularly upwardly as defined by the leg 436 of a hanging component represented generally at 438. As above component 438 is inserted through standard channels extending from the bottom of a partial bore 444. With this arrangement, as noted above, the system 370 is not dislodgable from the wall component 422 by inadvertent forces exerted upwardly upon it. A conventional employment of a downwardly angularly oriented hanging component is shown in FIG. 14 at 440. A forcing of components 430 or 436 through the wall component 422 may be provided with a conventional hammer or a simple piece of wood.

Figure 15:
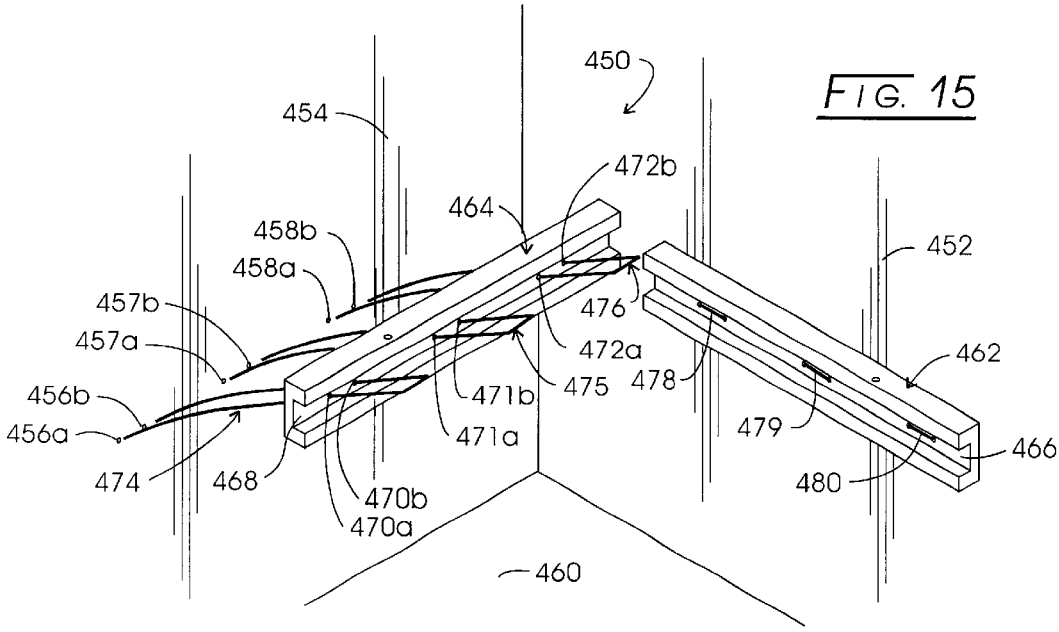
FIG. 15 is a perspective view of horizontally oriented support assemblies, one such assembly being shown during the procedure of its mounting.

The shelf support system of the invention also may be employed with shelves, for example of generally triangular shape, which are intended for mounting at a corner defined between two walls. Such an arrangement is revealed in connection with FIGS. 15 and 16. In FIG. 15, the shelf mounting system is represented generally at 450 which is located at the intersection of two walls defined by two intersecting wall forward surfaces 452 and 454. As before, wall receiving channels are formed at the noted acute angle with respect to each of the wall surfaces 452 and 454. In FIG. 15, note that paired wall openings, 456*a,b*–458*a,b* have been formed through wall surface 454. In this embodiment, however, the paired openings are horizontally aligned or at the same elevation from the floor of the corner represented at 460. A set of channel structured elongate support assemblies, represented generally at 462 and 464 are employed. Note that assembly 462 contains an elongate inwardly disposed receiving slot 466, while support assembly 464 is similarly configured with a slot 468. Support channels 470*a,b*–472*a,b* are formed within slot 468 and are angularly oriented downwardly toward floor 460 at the noted acute angle. Within the channels there are seen inserted the legs of respective hanging components shown generally at 474–476. The tips of the legs of these hanging components 474–476 are seen to be located for insertion within respective paired openings 456*a,b*–458*a,b* at wall surface 454. Support assembly 462 is seen in a fully mounted orientation against wall surface 452, the hanging components employed being represented generally at 478–480.

Figure 16:
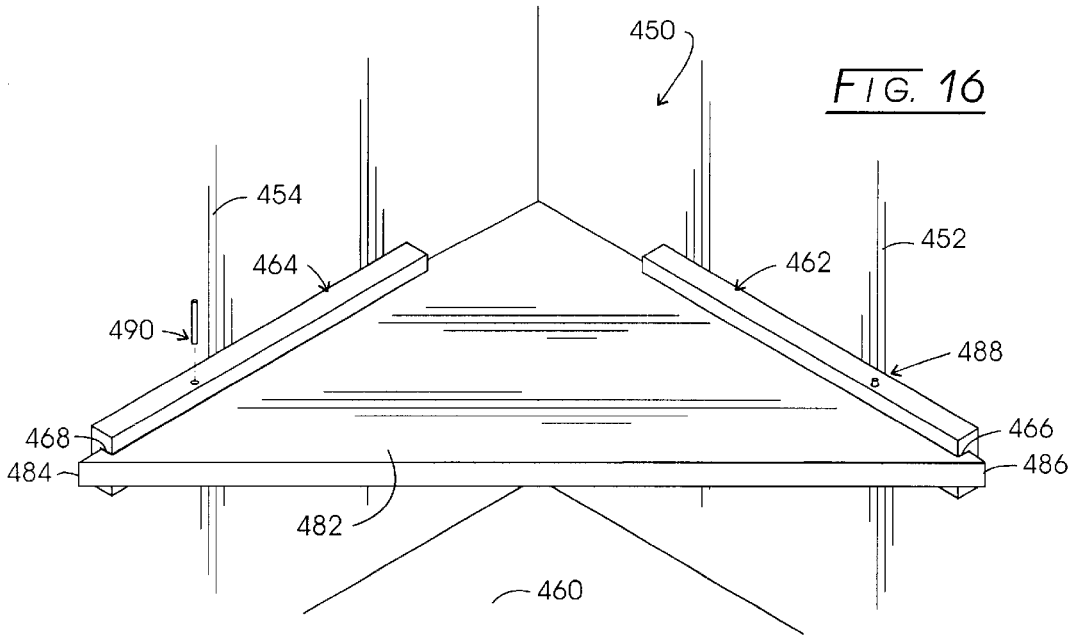
FIG. 16 is a perspective view of a corner shelf supported by two horizontally disposed support assemblies.

FIG. 15 reveals that, for the embodiment shown at 450, the shelf engaging portions of the assemblies 462 and 464 are provided as the respective slots 466 and 468. FIG. 16 reveals a triangular shaped shelf 482 having one edge 484 engaged within slot 468 and an angularly disposed opposite edge 486 engaged within slot 466. The figure also reveals that shelf 482 may be locked into the noted position by a peg and bore connector assembly as represented at 488 and 490 respectively at support assemblies 462 and 464. As is apparent, the shelf engaging portion may be provided as any horizontally disposed surface on the assemblies 462 and 464.

Figure 18:
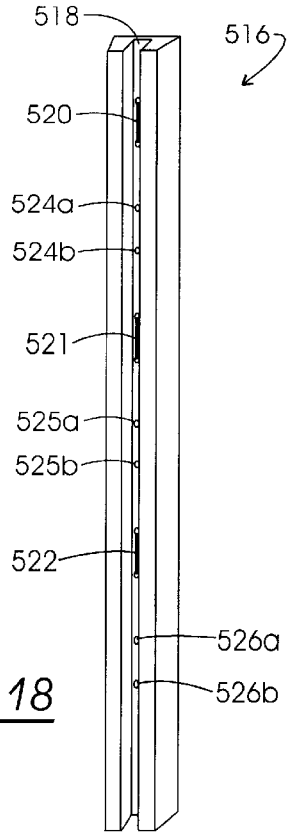
FIG. 18 is a perspective view of a standard or support device configured for utilization with the hanging component of FIG. 17.
Figure 19:
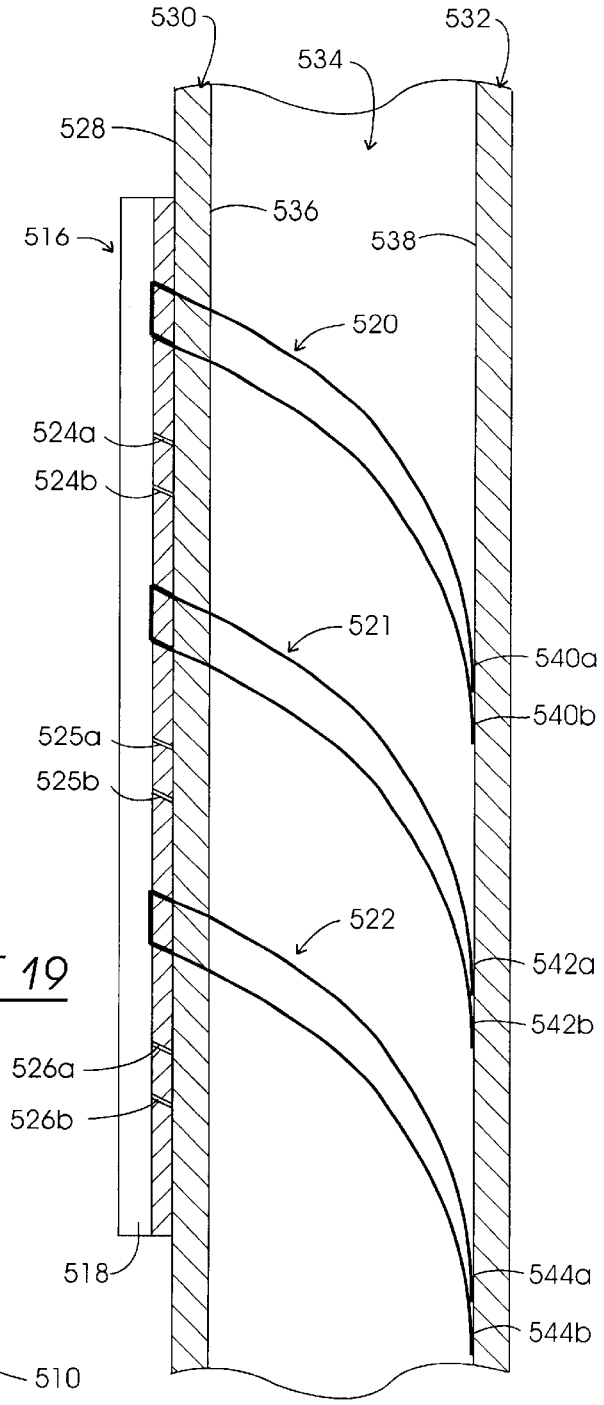
FIG. 19 is a partial sectional view of the assembly of FIG. 18 shown in combination with a partial sectional view of a wall.
Figure 17:
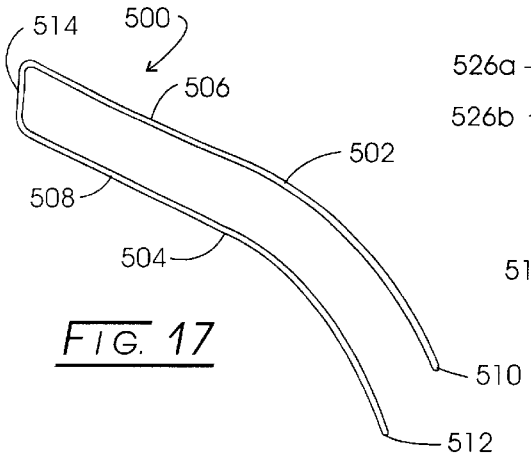
FIG. 17 is a perspective view of a hanging component configured having vertically disposed bifurcate legs.

In addition to being configured for a generally horizontal orientation of the transverse portion 28 of the bifurcate hanging component 26 as described in conjunction with FIG. 2, the hanging component transverse portion may assume a vertical orientation while performing in similar fashion. FIGS. 17–19 reveal this vertical configuration of the hanging component. Looking to FIG. 17, a bifurcate hanging component of this alternate design is represented generally at 500. Component 500 includes oppositely disposed legs 502 and 504 extending from respective base portions 506 and 508 to respective tips 510 and 512. Base portions 506 and 508 are united by an integrally formed normally vertically oriented transverse portion 514. The assembly 500 is intended for a variety of uses as discussed in connection with assemblies as described in connection with FIG. 2. A normally vertically oriented standard assembly is seen in FIG. 18 in general at 516 having a centrally disposed slot 518 within which a sequence of spaced apart paired standard channels are disposed. The figure reveals the transverse portions of three vertically oriented bifurcate hanging components 520–522, with the standard openings for additional paired standard channels being represented at 524*a,b*–526*a, b*.

Looking to FIG. 19, the standard assembly 516 is seen mounted against the outwardly disposed surface 528 of a wall structure formed of two drywall implemented wall components 530 and 532 which are arranged in parallel and spaced apart to define a cavity 534 extending between the respective interior surfaces 536 and 538 of the wall components 530 and 532. As in the earlier embodiment, note that the tips 540*a,b* of hanging component 520 abut against interior surface 538 of wall component 532 to provide the noted fulcrum-lever arm defined stabilization and support against heavier loads. In similar fashion, the tips 542*a,b* engage surface 538 and tips 544*a,b* are in similar supporting engagement.

Figure 21:
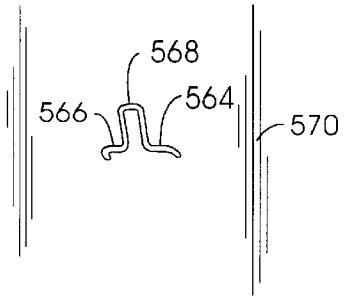
FIG. 21 is a front view showing mounting of the hanging assembly of FIG. 20 upon a wall.
Figure 20:
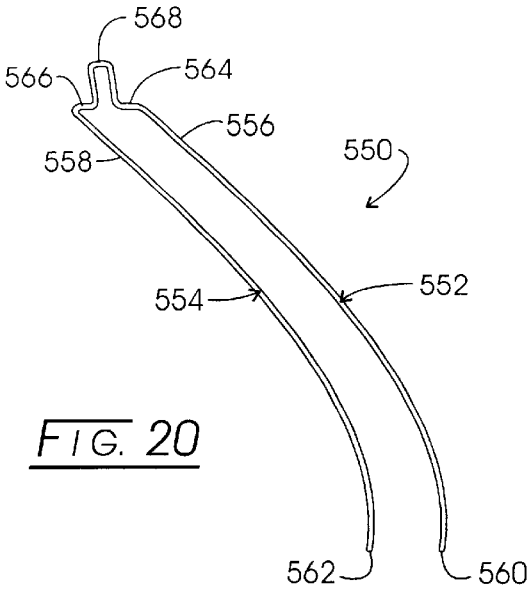
FIG. 20 is a perspective view of another hanging component embodiment of the invention.

The hanging components of the invention have application beyond their association with standards or shelf components as described above. Looking to FIG. 20, a hanging component represented generally at 550 is illustrated which is intended for directly providing for the hanging of implements such as pictures and the like on a wall. As before, these components as at 550 provide for relatively high load bearing capabilities without undue distortion to the wall surface. FIG. 20 shows hanging component 550 to be formed in bifurcate fashion having legs represented generally at 552 and 554 which extend from respective base regions 556 and 558 to corresponding tips 560 and 562. The transverse limiter portion, however, is formed with shoulders 564 and 566 which extend to an integrally formed loop 568 which is canted upwardly. When the hanging component 550 is inserted within a wall, it will have the appearance shown in FIG. 21 wherein the shoulder portions 564 and 566 along with integrally formed loop 568 are seen protruding slightly from wall surface 570.

Figure 22:
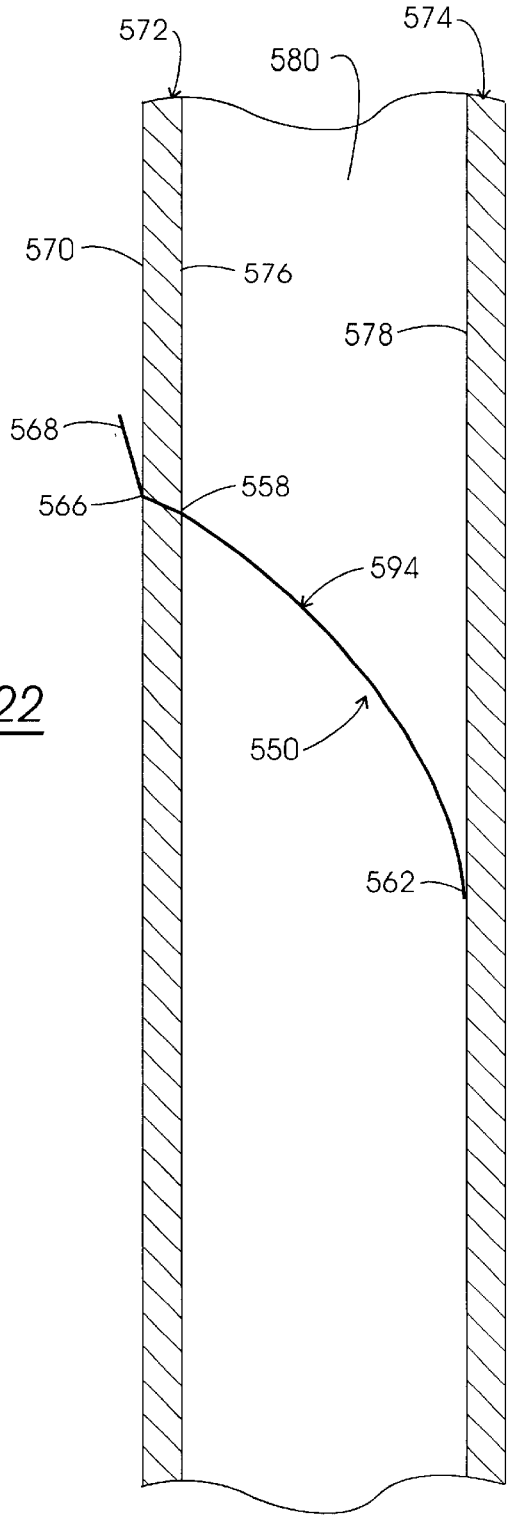
FIG. 22 is a partial sectional view of the hanging component of FIGS. 20 and 21 showing its insertion within a wall.

Referring to FIG. 22, the wall surface 570 is seen to be the outwardly disposed surface of a wall component represented generally at 572 which is arranged in parallel but spaced adjacency from a wall component represented generally at 574. The interior surfaces of wall components 572 and 574 are shown respectively at 576 and 578 and are spaced apart to define a wall cavity 580. The figure shows the upward cant of the loop portion 568 and further shows that the wall channels are pre-drilled at the desired acute angle. As before, when the hanging component 550 is inserted through such channels, the tips 560 and 562 of respective legs 552 and 554 will freely abuttably engage opposite interior wall surface 578 to provide the fulcrum defining structural integrity of the hanging approach.

Figure 23:
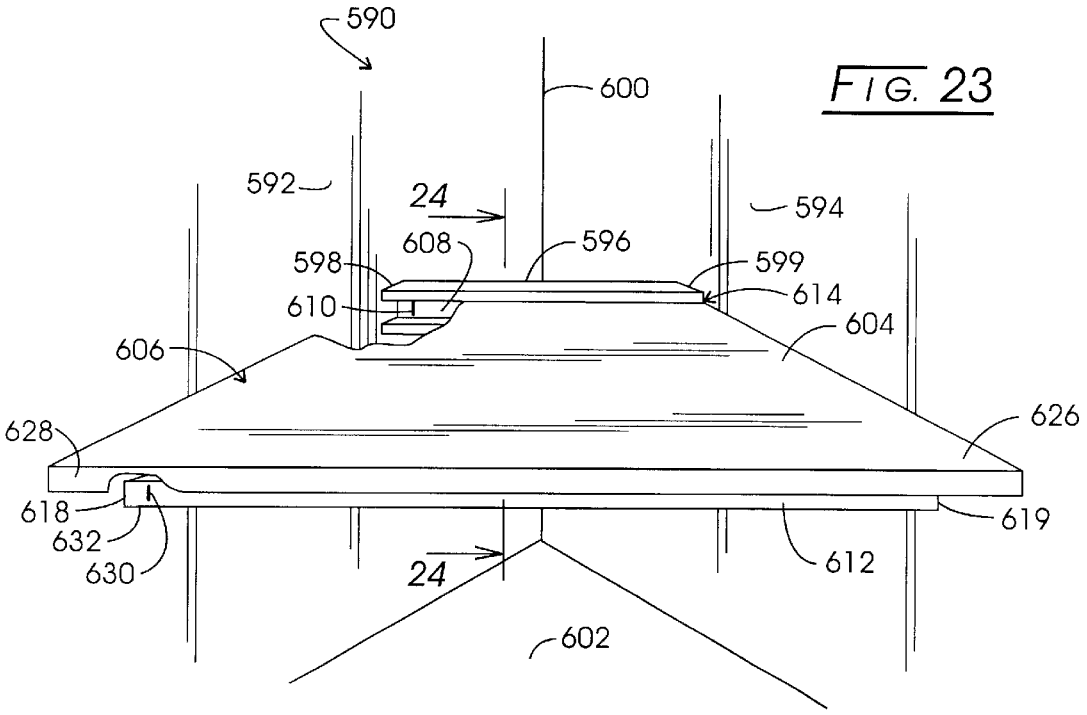
FIG. 23 is a perspective view of a corner shelf system according to the invention.
Figure 24:
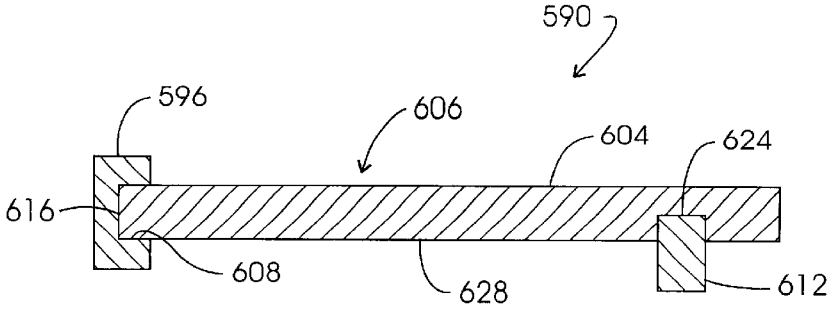
FIG. 24 is a sectional view taken through the plane 24—24 in FIG. 23.

Referring to FIGS. 23 and 24, another approach to utilizing the hanging components of the system of the invention in connection with a corner shelf system is portrayed. This shelf system. represented generally at 590 is mounted at the intersection 600 of two walls, the surfaces of which are represented at 592 and 594. System 590 includes a proximal shelf support assembly 596 formed of the early MDF material. Support assembly 596 is generally rectangular and its cross-sectional configuration is revealed in connection with FIG. 24 the assembly extends between beveled ends 598 and 599 which abut against respective wall surfaces 592 and 594. Assembly 596 is spaced outwardly from the intersection 600 a slight amount. To accommodate a length of the assembly from forward end to forward end of about 5½ inches. Assembly 596 is positioned above the floor 602 of elevation selected by the user with respect to the desired height of the upper side 604 of a shelf represented generally at 606. Formed within the forward facing surface of the assembly 596 is a shelf engaging portion 608 which, as seen in FIG. 24 is configured as a horizontal forward facing slot having a width corresponding with the thickness of the shelf 606.

Attachment of the assembly 596 to the walls 592 and 594 is provided utilizing hanger components and preferably those hanger components of a foreshortened variety as described at 312 in connection with FIG. 12. An integrally formed limiter portion 610 of that hanger component extending through support channels within assembly 596 adjacent one end is shown at 610. The bifurcate legs of this hanger component, as before, extend through support channels and then into wall receiving channels which are aligned therewith. However, with the instant embodiment, inasmuch as the bevel in end 598 typically will be 45 degrees, the support channels, which are aligned with the wall receiving channels will be generally at a 90 degree angular orientation with respect to the wall surfaces 592 or 594. Because of the particular structuring of the system 590, however, the hanging components are in effect, "trapped" as they are inserted through the wall structure. Insertion is carried out by the earlier described drilling or pushing the limiter portion 610 with a piece of wood or gently hammering the devices into the walls. During this endeavor, the support assembly 596 is utilized as a jig aligning the hanging components. As is apparent, an identical hanging component arrangement is provided adjacent the beveled end 599.

Once the proximal support assembly 596 is thus installed, the shelf 606 is slidably joined to a distal shelf support assembly 612. Note that the apex region 614 of the self 606 is configured as a truncated triangle such that its apex edge seen in 616 in FIG. 24 is engaged within the slot 608. Distal shelf supports 612 extends between oppositely disposed beveled ends 618 and 619, such bevels being at 45 degrees. As seen in FIG. 24, its upper edge or side constitutes a horizontally extending engaging portion extending into a horizontal slot 624 (FIG. 24) which, in turn, extends across the forward region 626 of shelf 606 and upwardly into its lower side 628. As in the case of proximal shelf support 596, the beveled ends 618 and 619 are attached to respective walls 592 and 594 by vertically orientated foreshortened hanging components. These hanging components may be aligned by support channels and driven into wall channels which are formed in the course of them being so driven. In FIG. 23, the limiter portion 630 of the hanging component extending through beveled end 618 is shown engaging contact surface 632. For ornamental purposes, the contact surface 632 may be provided within a partial bore which then may be plugged with a wooden or polymeric plugs such partial bores for example, are shown in FIGS. 13 and 14. The elevation of the distal assembly or support 612 above the floor 602 is selected to correspond with the elevation of support assembly 596. In developing the elevational position for support 612, however, a common level may be positioned upon the upper surface or side 604 of the shelf 606 and the elevation of support assembly 612 then is adjusted accordingly. Typically, its elevation will be slightly below that of proximal support assembly 596 in view of the different form of connection with shelf 606. Thus, the term "corresponding" is employed to describe this elevation.

Since certain changes may be made in the above-described method and system without departing from the scope of the invention herein involved, it is intended that all matter contained in the description thereof or shown in the accompanying drawings shall be interpreted as illustrative and not in a limiting sense.

What is claimed is:

1. A system for hanging an implement of a given load on a wall having an exterior surface and extending a given thickness inwardly to an interior surface defining one side of an interior wall cavity, said wall having a first wall receiving channel formed through said wall and extending from a first forward opening at said exterior surface downwardly through said given thickness at an acute angle with respect to a plane perpendicular to said exterior surface to said interior surface, comprising:

a hanging component formed of steel wire having a principal widthwise dimension of about 0.05 inch to about 0.054 inch, said hanging component having a first thin elongate leg of lengthwise extent greater than said given thickness, having a base portion extending to a first tip configured for insertion through said wall receiving channel, and having an integrally formed limiter portion transverse to said leg at said base portion and mountable in abutting relationship with respect to said exterior surface, said hanging component supporting said given load in correspondence with a vertically downwardly disposed vector and a horizontal vector extending inwardly toward said cavity, said vectors being defined by said acute angle and said given load.

2. The system of claim 1 wherein said acute angle is about 25 degrees to about 30 degrees.

3. The system claim 1 wherein said first wall receiving channel and said first leg have coextensive principal widthwise dimensions to provide intimate nesting of said first leg within said first wall receiving channel.

4. A system for hanging an implement of a given load on a wall having an exterior surface and extending a given thickness inwardly to an interior surface defining one side of an interior wall cavity, said wall cavity being defined between said interior surface and an opposite interior surface spaced a cavity distance therefrom, and said wall having a first wall receiving channel formed through said wall and extending from a first forward opening at said exterior surface downwardly through said given thickness at an acute angle with respect to a plane perpendicular to said exterior surface to said interior surface, comprising:

a hanging component having a first thin elongate leg of lengthwise extent, having a base portion extending to a first tip configured for insertion through said wall receiving channel, said leg lengthwise extent being greater than said cavity distance an amount selected to cause said first tip to abuttably engage said opposite interior surface when said first leg is inserted through said first wall receiving channel, and said hanging component having an integrally formed limiter portion transverse to said leg at said base portion and mountable in abutting relationship with respect to said exterior surface, said hanging component supporting said given load in correspondence with a vertically downwardly disposed vector and a horizontal vector extending inwardly toward said cavity, said vectors being defined by said acute angle and said given load.

5. The system of claim 4 wherein said first leg is canted downwardly adjacent said first tip to facilitate said abutable engagement with said opposite interior.

6. The system of claim 4 wherein said acute angle is about 25 degrees to about 30 degrees.

7. The system of claim 4 wherein said lengthwise extent of said first leg is about 6.7 inches.

8. A system for hanging an implement of a given load on a wall having an exterior surface and extending a given thickness inwardly to an interior surface defining one side of an interior wall cavity, said wall having a first wall receiving channel formed through said wall and extending from a first forward opening at said exterior surface downwardly through said given thickness at an acute angle with respect to a plane perpendicular to said exterior surface to said interior surface and a second wall receiving channel horizontally aligned with and spaced a predetermined horizontal distance from said first receiving channel formed through said wall and extending from a second forward opening at said exterior surface downwardly through said given thickness at an acute angle with respect to a plane perpendicular to said exterior surface to said interior surface, comprising:

a hanging component formed of steel wire having first and second thin elongate legs, each of lengthwise extent greater than said given thickness, said first leg having a first base portion extending to a first tip configured for insertion through said first wall receiving channel and said second leg having a second base portion extending to a second tip configured for insertion through said second wall receiving channel and having an integrally formed limiter portion extending transversely inwardly between said first and second base portions and mountable in said abutting relationship with respect to said exterior surface, said hanging component supporting said given load in correspondence with a vertically downwardly disposed vector and a horizontal vector extending inwardly toward said cavity, said vectors being defined by said acute angle and said given load.

9. The system of claim 8 wherein said lengthwise extent of said first and second legs is about 6.7 inches.

10. The system of claim 8 wherein said limiter portion has a widthwise extent of about 0.6 inch.

11. A system for hanging an implement of a given load on a wall having an exterior surface and extending a given thickness inwardly to an interior surface defining one side of an interior wall cavity, said wall having a first wall receiving channel formed through said wall and extending from a first forward opening at said exterior surface downwardly through said given thickness at an acute angle with respect to a plane perpendicular to said exterior surface to said interior surface, comprising:

a first standard having a first forward face and extending a standard thickness to a wall engaging face positioned against said wall exterior surface, having a first standard channel formed through said first standard and extending from a first forward opening at said first forward face downwardly through said standard thickness at said acute angle with respect to a plane perpendicular to said first forward face to said wall engaging face, said first standard channel being aligned with said first wall receiving channel; and a hanging component formed of steel wire having a first thin elongate leg of lengthwise extent greater than said given thickness, having a base portion extending to a first tip configured for insertion through said first standard channel and said first wall receiving channel, and having an integrally formed limiter portion transverse to said leg at said base portion and mountable in abutting relationship with said first forward face, said hanging component supporting said given load in correspondence with a vertically downwardly disposed vector and a horizontal vector extending inwardly toward said cavity, said vectors being defined by said acute angle and said given load.

12. The system of claim 11 wherein said wall has a second wall receiving channel aligned with and spaced a predetermined horizontal distance from said first receiving channel formed through said wall and extending from a second forward opening at said exterior surface downwardly through said given thickness at an acute angle with respect to a plane perpendicular to said exterior surface to said interior surface, including:

a second standard channel aligned with and spaced a predetermined horizontal distance from said first standard channel formed through said first standard and extending from a second forward opening at said first forward face downwardly through said given thickness at an acute angle with respect to a plane perpendicular to said first forward face to said wall engaging face, said second channel being aligned with said second wall receiving channel; and said hanging component includes a second thin elongate leg having a second base portion extending to a second tip configured for insertion through said second wall receiving channel and said second standard channel, said limiter portion extending transversely inwardly between said first and second base portions and mountable in said abutting relationship with said first forward face.

13. A system for attaching a shelf of a given width for supporting a given load, to a wall having an exterior surface and extending a given wall thickness inwardly to an interior surface defining one side of an interior wall cavity, said wall having a first wall receiving channel formed through said wall and extending from a first forward opening at said exterior surface downwardly through said given wall thickness at an acute angle with respect to a plane perpendicular to said exterior surface to said interior surface and a second wall receiving channel having a second forward opening horizontally aligned with and spaced a first predetermined horizontal distance from said first forward opening, being formed through said wall and extending from said second forward opening at said exterior surface downwardly through said given thickness at an acute angle with respect to a plane perpendicular to said exterior surface to said interior surface, comprising:

a first standard having a first forward face and extending a first standard thickness to a first wall engaging face positioned against said wall exterior surface, having a first standard channel being formed through said first standard thickness and extending from a first forward opening at said first forward face downwardly through said first standard thickness at an acute angle with respect to a plane perpendicular to said first forward face to said first wall engaging face, said first standard first channel being aligned with said first wall receiving channel;

a second standard having a second standard forward face and extending a second standard thickness to a second wall engaging face positioned against said exterior wall surface, having a second standard first channel formed through said second standard thickness and extending from a second forward opening at said second standard forward face downwardly through said second standard thickness at an acute angle with respect to a plane perpendicular to said second standard forward face to said second wall engaging face, said second standard first channel being aligned with said second wall receiving channel;

a first hanging component having a first thin elongate first component leg of lengthwise extent greater than the sum of said first standard thickness and said given wall thickness, having a first component first base portion extending to a first component first tip configured for insertion through said first standard first channel and said first wall receiving channel, and having an integrally formed first standard limiter portion transverse to said first component leg at said first base portion mountable in abutting relationship with said first standard forward face, said first hanging component supporting said given load in correspondence with a first vertically downwardly disposed vector and a first horizontal vector extending inwardly toward said cavity, said first vectors being defined by said acute angle and a portion of said given load;

a second hanging component having a first thin elongate second component leg of lengthwise extent greater than the sum of said second standard thickness and said given wall thickness, having a second component first base portion extending to a second component first tip configured for insertion through said second standard first channel and said second wall receiving channel, and having an integrally formed second standard limiter portion transverse to said second component first leg at said second component first base portion mountable in abutting relationship with said second standard forward face, said second hanging component supporting said given load in correspondence with a second vertically downwardly disposed vector and a second horizontal vector extending inwardly toward said cavity, said second vectors being defined by said acute angle and a portion of said given load; and first and second shelf brackets fixed respectively to said first and second standards for supporting a horizontal load bearing surface when mounted on a wall.

14. The system of claim 13, said wall having a third wall receiving channel having a third forward opening horizontally aligned with and spaced a second predetermined horizontal distance from said first wall receiving channel first forward opening, formed through said wall and extending from said third forward opening at said exterior surface downwardly through said given thickness at an acute angle with respect to a plane perpendicular to said exterior surface to said interior surface and a fourth wall receiving channel having a fourth forward opening horizontally aligned with and spaced apart a third predetermined distance from said second wall receiving channel second forward opening being formed through said wall and extending from said fourth forward opening at said exterior surface downwardly through said given thickness at an acute angle with respect to a plane perpendicular to said exterior surface to said interior surface, comprising a first standard second channel having a third forward opening horizontally aligned with and spaced apart said second predetermined horizontal distance from said first standard first channel first forward opening, being formed through said first standard and extending from said third forward opening at said first standard forward face downwardly through said first standard thickness at an acute angle with respect to a plane perpendicular to said first standard forward face to said first wall engaging face, said first standard second channel being aligned with said third wall receiving channel;

a second standard second channel having a fourth forward opening horizontally aligned with and spaced apart said third predetermined horizontal distance from said second forward opening, being formed through said second standard and extending from said fourth forward opening downwardly through said second standard thickness at an acute angle with respect to a plane perpendicular to said second standard forward face to said second wall engaging face, said second standard second channel being aligned with said fourth wall receiving channel;

said first hanging component having a second thin elongate first component leg of lengthwise extent greater than the sum of said first standard thickness and said given wall thickness, having a first component second base portion extending to a first component second tip configured for insertion through said first standard second channel and said third wall receiving channel, said first standard limiter portion extending transversely between said first component first and second base portions and mountable in said abutting relationship with said first standard forward face; and said second hanging component having a second thin elongate second component leg of lengthwise extent greater than the sum of said second standard thickness and said given wall thickness, having a second component second base portion extending to a second component second tip configured for insertion through said second standard second channel and said fourth wall receiving channel, said second standard limiter portion extending transversely between said second component first and second base portions and mountable in abutting relationship with said second standard forward face.

15. A method for hanging an implement of given load on a wall having an exterior surface and extending a given thickness inwardly to an interior surface defining one side of an interior wall cavity, comprising the steps of:

forming a first wall receiving channel through said wall extending from a first forward opening at said exterior surface downwardly through said given thickness at an acute angle with respect to a plane perpendicular to said exterior surface to said interior surface;

providing a first hanging component formed of steel wire having a principal widthwise dimension of about 0.05 inch to about 0.054 inch having a thin first elongate leg of lengthwise extent greater than said given thickness, said first wall receiving channel being formed and said first leg of said hanging component being provided having coextensive principal widthwise dimensions to provide intimate nesting of said first leg within said first wall receiving channel, said hanging component having a base portion extending to a first tip and an integrally formed limiter portion disposed transversely to said first leg at said base portion to support said given load in correspondence with a vertically downwardly disposed vector and a horizontal vector extending inwardly toward said cavity, said vectors being defined by said acute angle and said given load;

inserting said first leg of said first hanging component through said first wall receiving channel such that said limiter portion is mounted in abutting relationship with respect to said exterior surface; and supporting said implement with said first hanging component at said base portion.

16. The method of claim 15, wherein said first wall receiving channel is formed at a said acute angle of about 25 degrees to 30 degrees.

17. A method for hanging an implement of given load on a wall having an exterior surface and extending a given thickness inwardly to an interior surface defining one side of an interior wall cavity, said wall cavity being defined between said interior surface and an opposite interior surface spaced a cavity distance therefrom, comprising the steps of:

forming a first wall receiving channel through said wall extending from a first forward opening at said exterior surface downwardly through said given thickness at an acute angle with respect to a plane perpendicular to said exterior surface to said interior surface;

providing a first hanging component having a thin first elongate leg of lengthwise extent greater than said given thickness an amount selected to cause said first tip to abuttably engage said opposite interior surface when said first leg is inserted through said first wall receiving channel, a base portion extending to a first tip and an integrally formed limiter portion disposed transversely to said first leg at said base portion, to support said given load in correspondence with a vertically downwardly disposed vector and a horizontal vector extending inwardly toward said cavity, said vectors being defined by said acute angle and said given load;

inserting said first leg of said first hanging component through said first wall receiving channel such that said limiter portion is mounted in abutting relationship with respect to said exterior surface; and supporting said implement with said first hanging component at said base portion.

18. The method of claim 17, wherein said first leg is provided being canted downwardly adjacent said first tip to facilitate said abutable engagement with said opposite interior surface.

19. The method of claim 17, wherein said first wall receiving channel is formed at a said acute angle of about 25 degrees to 30 degrees.

20. The method of claim 17, wherein said first wall receiving channel is formed and said first leg of said hanging component is provided having coextensive principal widthwise dimensions to provide intimate nesting of said first leg within said first wall receiving channel.

21. A method for hanging an implement of given load on a wall having an exterior surface and extending a given thickness inwardly to an interior surface defining one side of an interior wall cavity, comprising the steps of:

providing a tool for drilling through said wall inwardly to said interior surface;

providing a first standard having a first forward face and extending a standard thickness to a wall engaging face, having a first standard channel formed through said standard and extending from a first forward opening at said first forward face downwardly through said standard thickness at an acute angle with respect to a plane perpendicular to said first forward face to said wall engaging face;

positioning said first standard wall engaging face against said exterior wall surface;

forming a first wall receiving channel through said wall extending from a first forward opening at said exterior surface downwardly through said given thickness at an acute angle with respect to a plane perpendicular to said exterior surface to said interior surface by inserting said tool through said first standard channel and drilling through said wall inwardly to said interior surface;

providing a first hanging component having a thin first elongate leg of lengthwise extent greater than said given thickness, a base portion extending to a first tip and an integrally formed limiter portion disposed transversely to said first leg at said base portion, to support said given load in correspondence with a vertically downwardly disposed vector and a horizontal vector extending inwardly toward said cavity, said vectors being defined by said acute angle and said given load;

inserting said first leg of said first hanging component through said first standard channel and said first wall receiving channel such that said limiter portion is mounted in abutting relationship with respect to said first forward face; and supporting said implement from said standard.

22. The method of claim 21, including the steps of:

providing said first standard having a second standard channel with a second forward opening horizontally aligned with and spaced a predetermined horizontal distance from said first standard channel first forward opening, and being formed through said standard thickness and extending from said second forward opening at said first forward face downwardly through said given thickness at an acute angle with respect to a plane perpendicular to said first forward face to said wall engaging face;

providing said hanging component having a second thin elongate leg with a second base portion extending to a second tip, said limiter portion being integrally formed with and extending transversely between said first and second base portions;

inserting said tool through said second standard channel and drilling through said wall inwardly to said interior surface to form a second wall receiving channel at said acute angle;

inserting said second leg of said hanging component through said second standard channel and said second wall receiving channel such that said limiter portion is mounted in abutting relationship with said first forward face.

* * * * *